United States Patent [19]

Miller et al.

[11] Patent Number: 4,494,259

[45] Date of Patent: Jan. 22, 1985

[54] ADJUSTABLE BED

[75] Inventors: Robert E. Miller, Charlotte, N.C.; Joseph L. Russo; Richard Sonder, both of New York, N.Y.; Abraham H. Soni, Stillwater, Okla.

[73] Assignee: Simmons Universal Corporation, New York, N.Y.

[21] Appl. No.: 325,048

[22] Filed: Nov. 25, 1981 (Under 37 CFR 1.47)

[51] Int. Cl.[3] ..... A61G 7/06

[52] U.S. Cl. ..... 5/66; 5/63; 5/64

[58] Field of Search ..... 5/60–69

[56] References Cited

U.S. PATENT DOCUMENTS

| | | | |
|---|---|---|---|
| 2,120,732 | 6/1938 | Comper et al. | 5/66 |
| 2,517,466 | 8/1950 | Cox | 5/67 |
| 3,237,212 | 3/1966 | Hillenbrand et al. | 5/68 |
| 3,317,931 | 5/1967 | Benoit et al. | 5/63 |
| 3,593,350 | 7/1971 | Knight et al. | 5/66 |
| 3,608,102 | 9/1971 | Goodman | 5/68 |
| 3,644,945 | 2/1972 | Goodman et al. | 5/63 |
| 4,110,856 | 9/1978 | Benoit et al. | 5/68 |

*Primary Examiner*—Alexander Grosz
*Assistant Examiner*—Michael F. Trettel
*Attorney, Agent, or Firm*—Bell, Seltzer, Park & Gibson

[57] ABSTRACT

An adjustable bed having mattress supporting portions for supporting a mattress for an occupant and in a variety of positions, a base frame for supporting the mattress supporting portions, and position controlling mechanism operatively interconnecting the mattress supporting portions and the base frame. The position controlling mechanism comprises an upper frame operatively connected with the mattress supporting portions for moving the portions relative to one another, lifting arms operatively connecting the upper frame and the base frame, and a plurality of drive motors operatively connected with the upper frame and with the lifting arms for moving the upper frame and the lifting arms and thereby positioning the mattress supporting portions in the desired positions. The operation of the position controlling mechanism is such that the portions of the bed may be moved both vertically and angularly through raised and lowered horizontal positions, Trendelenburg and reverse Trendelenburg positions, headlift and seated positions. Movement to and from headlift positions is accomplished with coordinated translation of the mattress supporting portions so as to move the head of an occupant essentially directly vertically rather than arcuately. A foot drop position approximating vertical is available so as to accommodate seated positioning of an occupant.

4 Claims, 23 Drawing Figures

ADJUSTABLE BED

FIELD AND BACKGROUND OF INVENTION

This invention relates to an adjustable bed and, more particularly, to an improvement in the position controlling mechanism of such a bed which facilitates movement of the bed into a variety of positions.

Adjustable beds are widely used in hospitals and the like in order to accommodate positioning of an occupant of a bed in a variety of positions. Heretofore, adjustable beds have provided for either manual adjustment of the position of elements of the bed or motor controlled positioning of elements of the bed. The present invention is particularly concerned with motor controlled adjustable beds.

Previously known motor controlled adjustable beds have been able to attain a variety of positions for an occupant of the bed. However, the range of positions has been somewhat limited. By way of example, it has been possible to attain at least limited lifting of a head portion of an adjustable bed, so as to raise the head of an occupant toward a sitting position. Similarly, it has been possible to attain at least pivotal movement between foot and thigh portions, so as to accommodate bending of the leg of an occupant. Finally, it has been possible to move such a bed to particular predetermined positions which may be indicated for medical reasons, such as a Trendelenburg or reverse Trendelenburg position. However, such movements, when available, are both somewhat limited in scope and may require significant space around the adjustable bed.

BRIEF DESCRIPTION OF INVENTION

With the foregoing discussion in mind, it is an object of the present invention to accommodate a variety of positions of an adjustable bed of the type generally described above. In realizing this object of the present invention, the range of movements of elements of the bed is significantly enlarged. Further, movement of the bed into positions not otherwise readily obtainable is facilitated.

Yet a further object of the present invention is to provide, in an automatic bed having mattress supporting portions, a base frame for supporting the mattress supporting portions, and position controlling mechanism operatively interconnecting the mattress supporting portions of the base frame, an improvement in the position controlling mechanism which facilitates movement of the bed into a variety of positions heretofore unattainable while minimizing the room space required to accommodate such positions. The improvement takes the form of an upper frame operatively connected with mattress supporting portions of the adjustable bed, and lifting arms operatively connecting the upper frame with the base frame. Motor means are operatively connected with the upper frame and with the lifting arms for moving the upper frame and the lifting arms and thereby for positioning mattress supporting portions of the bed in desired positions. By this means, and as pointed out more fully hereinafter, the mattress supporting portions may be moved vertically as well as pivoted to provide an enhanced range of possible positions.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
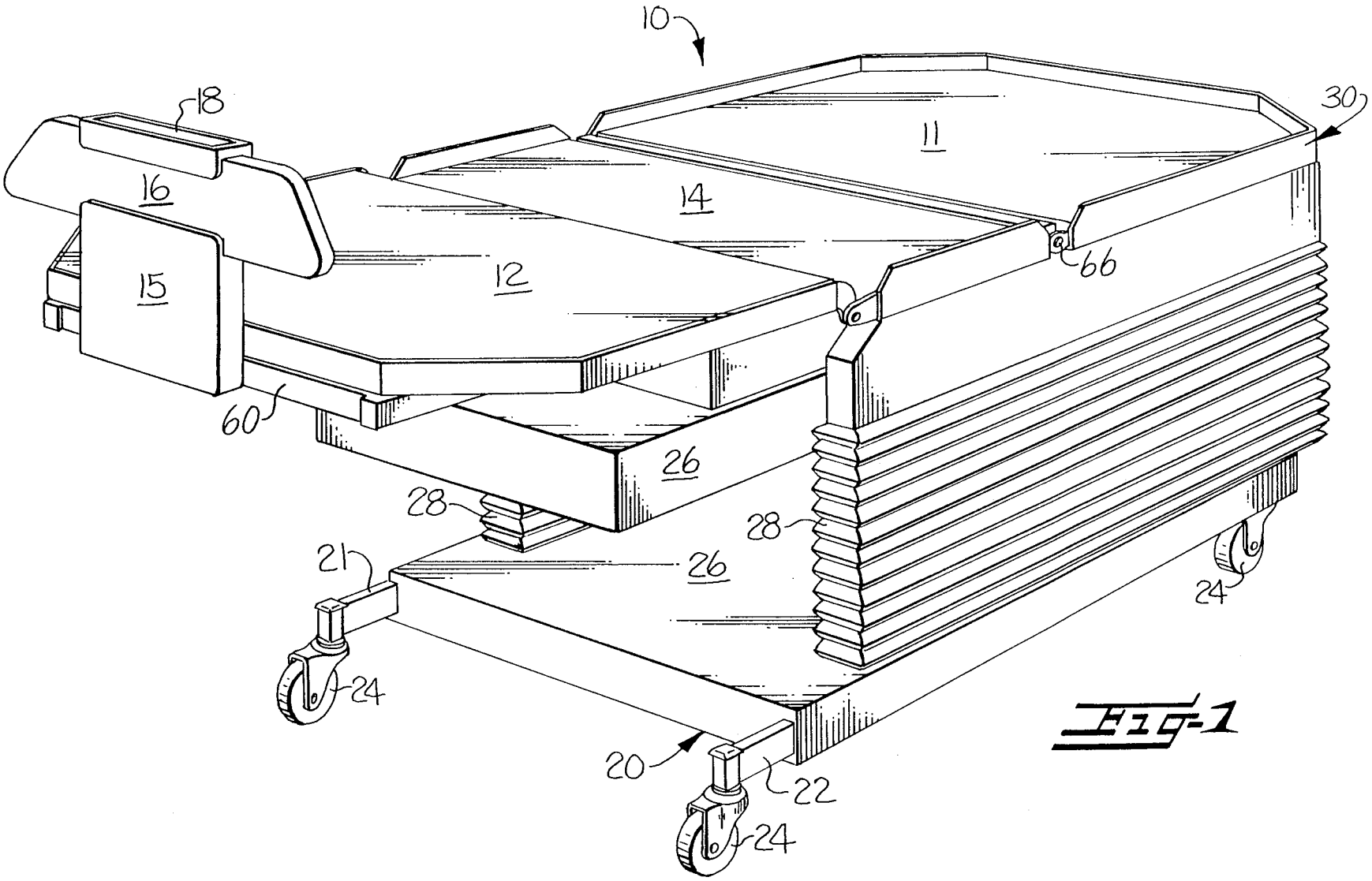
FIG. 1 is a perspective view of an adjustable bed in accordance with the present invention.

Referring now more particularly to the accompanying drawings, an adjustable bed in accordance with the present invention is there shown and generally indicated at 10. As particularly illustrated in FIG. 1, the bed 10 appears as if in use, and has mattress supporting portions for supporting a mattress for an occupant in a variety of positions. The mattress supporting portions, which may be referred to as a mattress platform or as mattress pans, include a head portion 11 at a head end of the bed, a foot portion 12 at a foot end of the bed, and a thigh portion 14 between the head and foot portions. Adjacent the foot end of the bed 10 is a footboard support 15 and a footboard 16 on which a control console 18 is mounted.

A base frame means, generally indicated at 20, is provided for supporting the mattress supporting portions 11, 12, 14. The base frame means 20 includes main lengthwise fore and aft or head-to-foot frame members 21, 22 having at respective head and foot ends thereof casters 24 for engaging the floor. Cross tubes 25 extend between the lengthwise members 21, 22 of the base frame means 20 in order to provide structural integrity. As arranged for use (and shown in FIG. 1) a number of the elements of the adjustable bed which will be described more fully hereinafter are enclosed within a cover 26 and a depending bellows 28 so as to provide an attractive and neat appearance for the bed 10.

Figure 2:
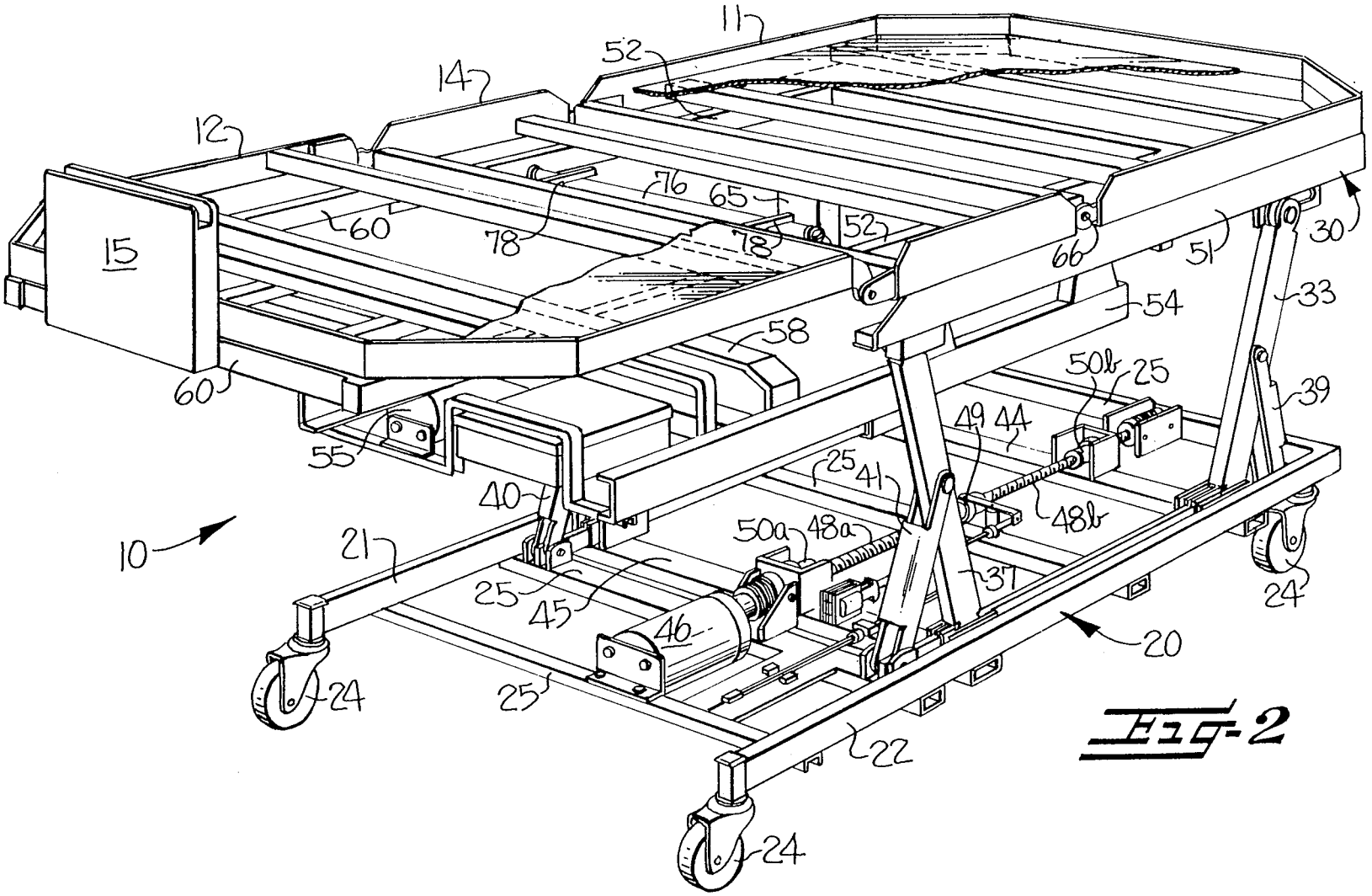
FIG. 2 is a view similar to FIG. 1, illustrating certain frame portions and motor means of the bed of FIG. 1.
Figure 3:
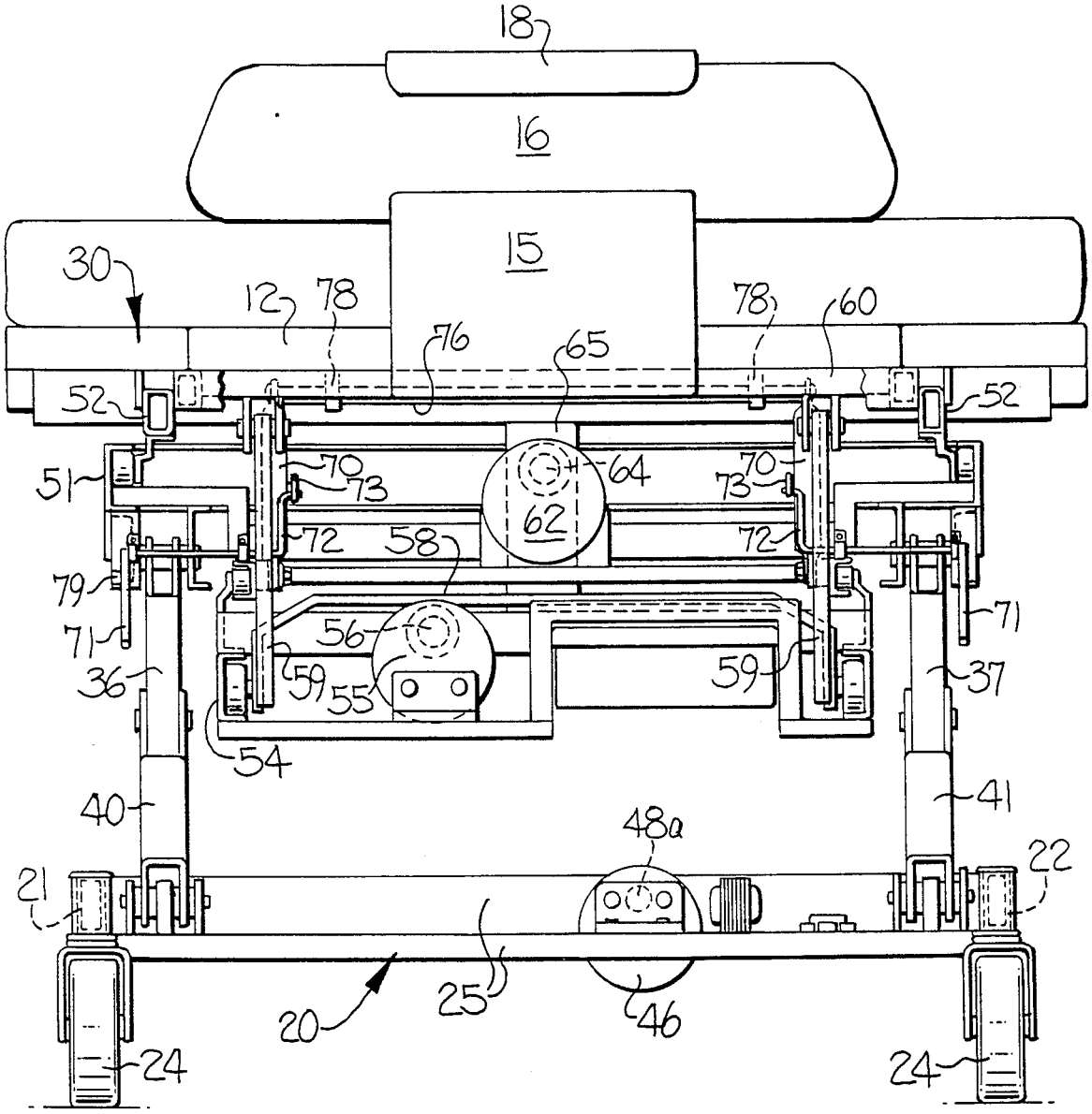
FIG. 3 is an end elevation view of the bed of FIGS. 1 and 2.

As will become more clear from FIG. 2 and those which follow and from the discussion which follows, the mattress supporting portions 11, 12, 14 are operatively interconnected with the base frame means 20 by position controlling mechanism. The position controlling mechanism comprises, stated broadly, upper frame means having a head end and a foot end and operatively connected with the mattress supporting portions for moving the mattress supporting portions relative to one another, lifting arm means operatively connecting the upper frame means with the base frame means 20 for moving the head and foot ends of the upper frame means vertically relative to the base frame means 20, and motor means operatively connected with the upper frame means and with the lifting arm means for moving the upper frame means and the lifting arm means and thereby for positioning the mattress supporting portions 11, 12, 14 in desired positions. Preferably, and as described more fully hereinafter, the motor means takes the form of electrical motors controlled by operation of electrical switches provided within the console 18. It will be understood that alternative motor means, such as hydraulic or pneumatic motors, may in some circumstances be usable.

Referring now more particularly to FIG. 2 and following, the upper frame means is generally indicated at 30 and includes a lifting frame structure and a sliding frame structure. The upper frame means 30 is operatively connected with the base frame means 20 by a pair of head end lift arms 32, 33 and a pair of foot end lift arms 36, 37. Each lift arm is pivotally connected at the upper end thereof by a suitable pivot pin. Pivotally connected to each lift arm 32, 33, 36, 37, intermediate the length thereof, is a corresponding stabilizing arm 38, 39, 40, 41. The lower end of each stabilizing arm is pivotally connected to the base frame means 20.

The lower end of each lifting arm 32, 33, 36, 37 is pivotally connected to a corresponding one of a head end subframe 44 and a foot end subframe 45. The head end subframe and foot end subframe are mounted on the base frame means 20 for movement therealong (FIGS. 5, 6, 8 and 16).

Movement of the lifting arms 32, 33, 36, 37 is under the control of a lifting drive motor means 46 which, through a suitable reduction gearing, drives a lifting ball screw which is divided between a foot end portion 48*a* and a head end portion 48*b*. The ball screw portions 48*a*, 48*b* are joined by means of a clutch mechanism generally indicated at 49 and which is operative as described more fully hereinafter to control operation of the bed 10. Each of the ball screws is engaged by a corresponding ball nut 50*a*, 50*b* fixed to a corresponding subframe 44, 45. Upon rotation of the ball screws 48*a*, 48*b* as driven by the lifting motor means 46, one or both of the subframes 44, 45 is moved so as to move the corresponding lifting arms.

The ball screws 48*a*, 48*b* are of opposite hand. As a consequence, where the clutch 49 is actuated so as to couple the ball screws together for rotation at the same time and in a common rotational direction, the ball nuts 50*a*, 50*b* are moved toward one another or away from one another with a coordinated movement. That is, with rotation of the ball screws 48*a*, 48*b* in a first direction, while the clutch couples the two together, the ball nuts 50*a*, 50*b* are drawn toward one another. As a consequence, the upper frame means of the bed 10 is lowered while being maintained in a predetermined orientation, such as being horizontal. With rotation of both ball screws 48*a*, 48*b* in the opposite direction, the ball nuts 50*a*, 50*b* are moved apart and the bed is raised.

Selective actuation of the clutch means 49 will permit movement of the upper frame means into other orientations. For example, assuming that the mattress supporting portions 11, 12, 14 are arranged in co-planar generally horizontal array, movement of the foot end ball nut 50*a* may accomplish positioning of the adjustable bed 10 in a selected one of the positions known as Trendelenburg and reverse Trendelenburg. In Trendelenburg position, the foot of the bed is elevated over the head. In reverse Trendelenburg position, the head of the bed is elevated over the foot. In order to reach the Trendelenburg position, the bed may be lowered to the lowermost position and, upon actuating the lifting drive motor 46, the clutch 49 may be operated to disengage the ball screws 48*a*, 48*b*. As a consequence, only the foot end ball screw 48*a* would be driven in rotation, permitting movement of the foot end lifting arms 36, 37 so as to raise the foot end of the bed. Should it be desired to attain a reverse Trendelenburg position, the bed may be moved to its maximum elevated position and thereafter, upon actuation of the lifting drive motor 46 with the clutch 49 disengaged, the foot end ball screw 48*a* may be driven in such a manner as to lower the foot end of the bed and achieve the reverse Trendelenburg position. As will be clear, actuation of the lifting motor 46 with the clutch 49 engaged will lower and raise the bed while maintaining the particular angular attitude to which the upper frame means and the mattress supporting portions have been moved.

The mattress supporting portions 11, 12, 14 are constructed of peripheral frames having cross members and are operatively supported on and by, and connected with, a number of components of the upper frame means 30. The upper frame means 30 includes a component which essentially maintains a single head-to-foot orientation and position with respect to the base frame and is thus referred to as a stationary upper frame element 51. The stationary upper frame element 51 provides a connection point for the lift arms 32, 33, 36, 37. Additionally, the stationary upper frame element 51 provides support for an upper sliding frame 52, a lower sliding frame or intermediate frame 54, and certain other components as will be described more fully hereinafter.

Mounted on the lower moving frame or intermediate frame 54 is a foot drop drive motor 55 which drives a foot drop screw 56. By means of a foot drop yoke assembly 58 engaging the foot drop screw 56 and a foot drop arm 59 coupled to the yoke assembly 58, a swing frame 60 which forms a portion of the upper moving frame 52 may be pivoted about a pivot location defined by a pivot pin 61. The swing frame 60 underlies the foot wing or foot portion 12 of the mattress supporting portions of the bed 10 and, on being moved by operation of the foot drop motor 55, positions the foot end portion 12 at a desired position. As will be pointed out more fully hereinafter, the cooperation of these elements of the bed of the present invention with other elements yet to be described permits achieving bed positions approximating those of a chair, in order that a patient may essentially be seated upright. This is an unusual and distinguishing characteristic of the adjustable bed of the present invention.

Figure 4:
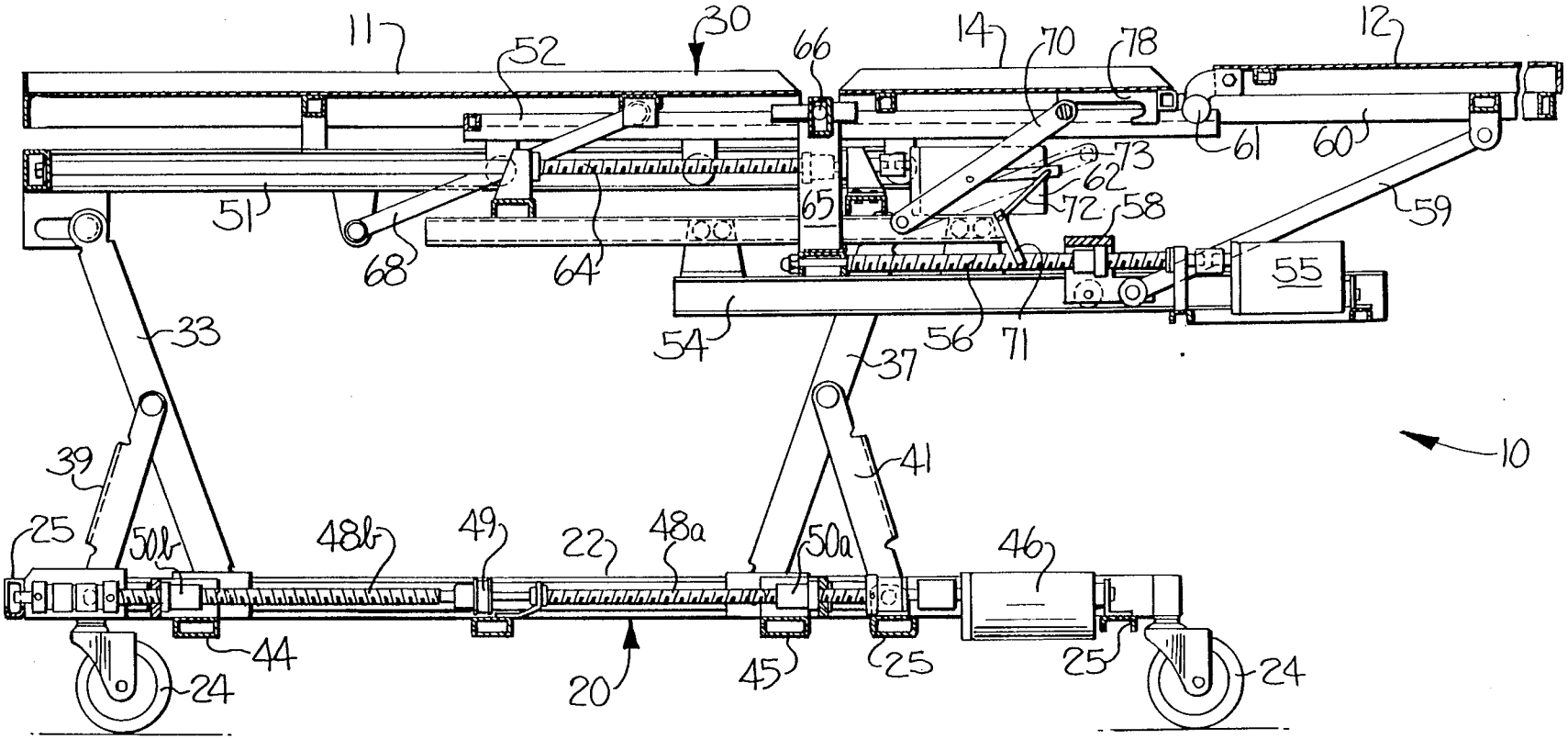
FIG. 4 is a side elevation view of the bed of FIGS. 1 through 3 illustrating one particular position for the bed.

Mounted on the stationary upper frame is a head lift drive motor 62 which drives a head lift screw 64. The head lift screw 64 is engaged by a drive nut mounted in a support member 65 which engages a number of components of the bed 10 of the present invention. First, the support member 65 is coupled, through a pivot pin 66, to a joint between the head end mattress supporting portion 11 and the thigh portion 14. Further, at its lower end, the support member 65 engages the moving intermediate frame 54. Finally, the support member 65 is coupled to the moving upper frame 52. As a consequence, when the head lift motor 62 is operated to rotate the head lift drive screw 64 in one particular direction, the support member 65 moves (to the left in FIGS. 4 and 5) in such a direction as to move the mattress supporting portions 11, 12, 14, the upper moving frame 52, and the intermediate moving frame 54 all in a common direction. As such movement occurs, a head wing lift arm 68 which extends between the head portion 11 and the stationary upper frame 51 causes the head wing portion 11 to be pivoted upwardly about the pivot point 66 mentioned earlier. Thus, the mattress supporting portions are moved in such a manner as to elevate the head of an occupant. It is to be noted that such head lifting or head elevation occurs during translation of the mattress supporting portions of the bed 10 of the present invention. That is, the movement of the elements of the bed 10 described hereinabove is such that the occupant's head is raised from the horizontal at the same time that the occupant's body is moved slightly in the horizontal plane so that the lifting movement of the head is essentially directly vertical rather than being through an arc. This is an important characteristic of the bed of the present invention, as facilitating the most efficient usage of the floor space in a hospital room.

Figure 5:
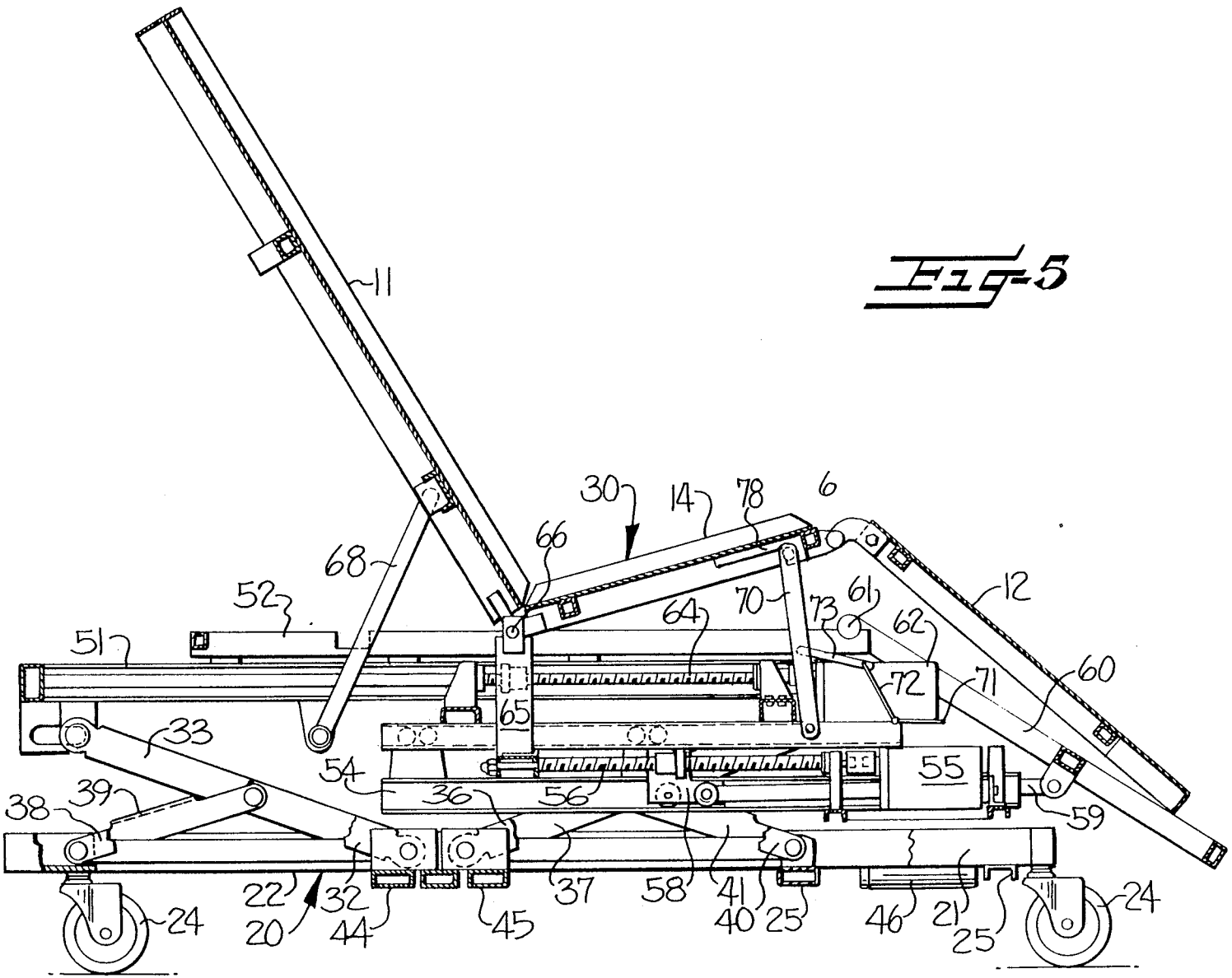
FIG. 5 is a view similar to FIG. 4, illustrating a different position for the bed.
Figure 6:
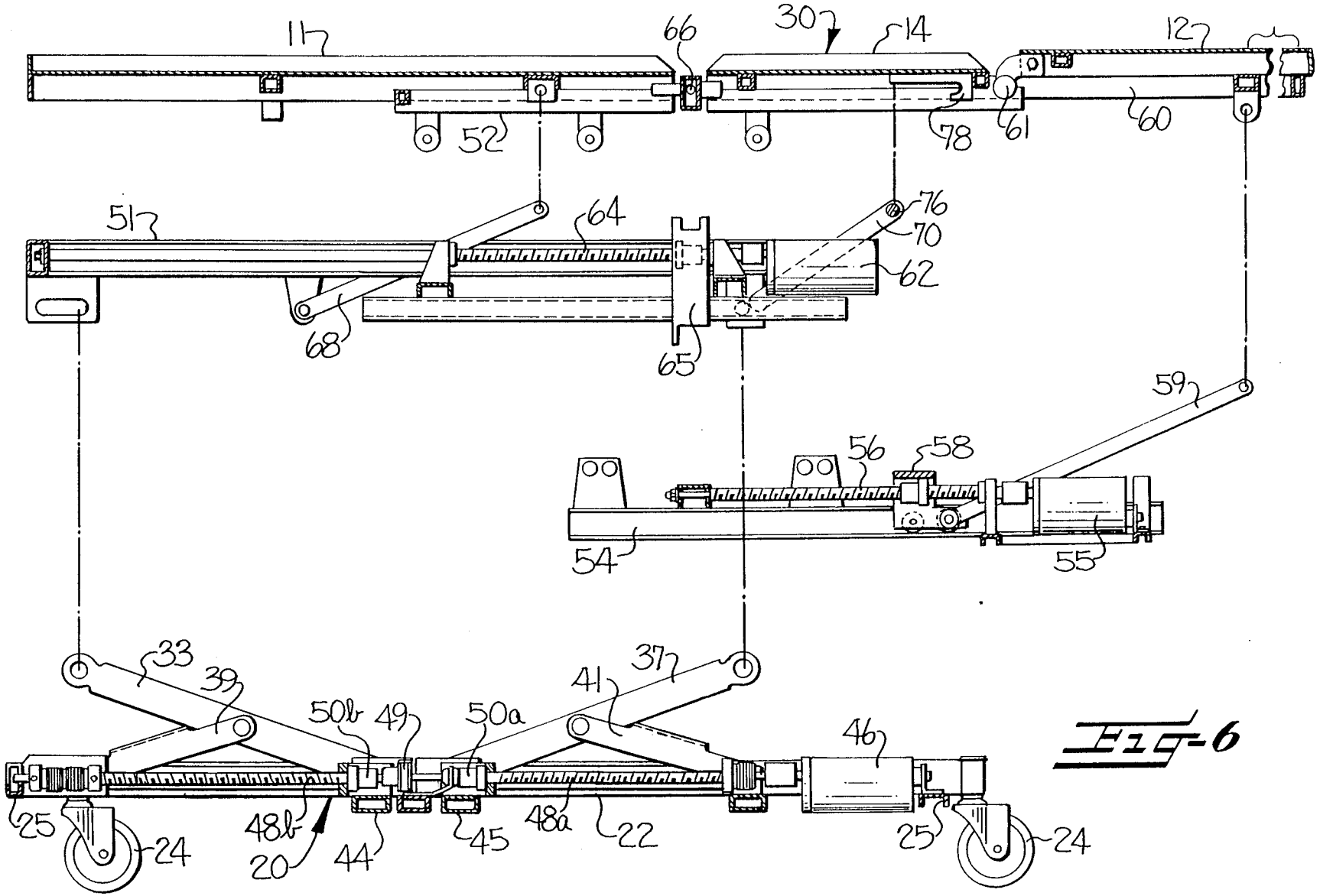
FIG. 6 is a view similar to FIGS. 4 and 5, partially exploded, in order to clarify certain relationships among elements of the frame of the bed of the present invention.
Figure 7:
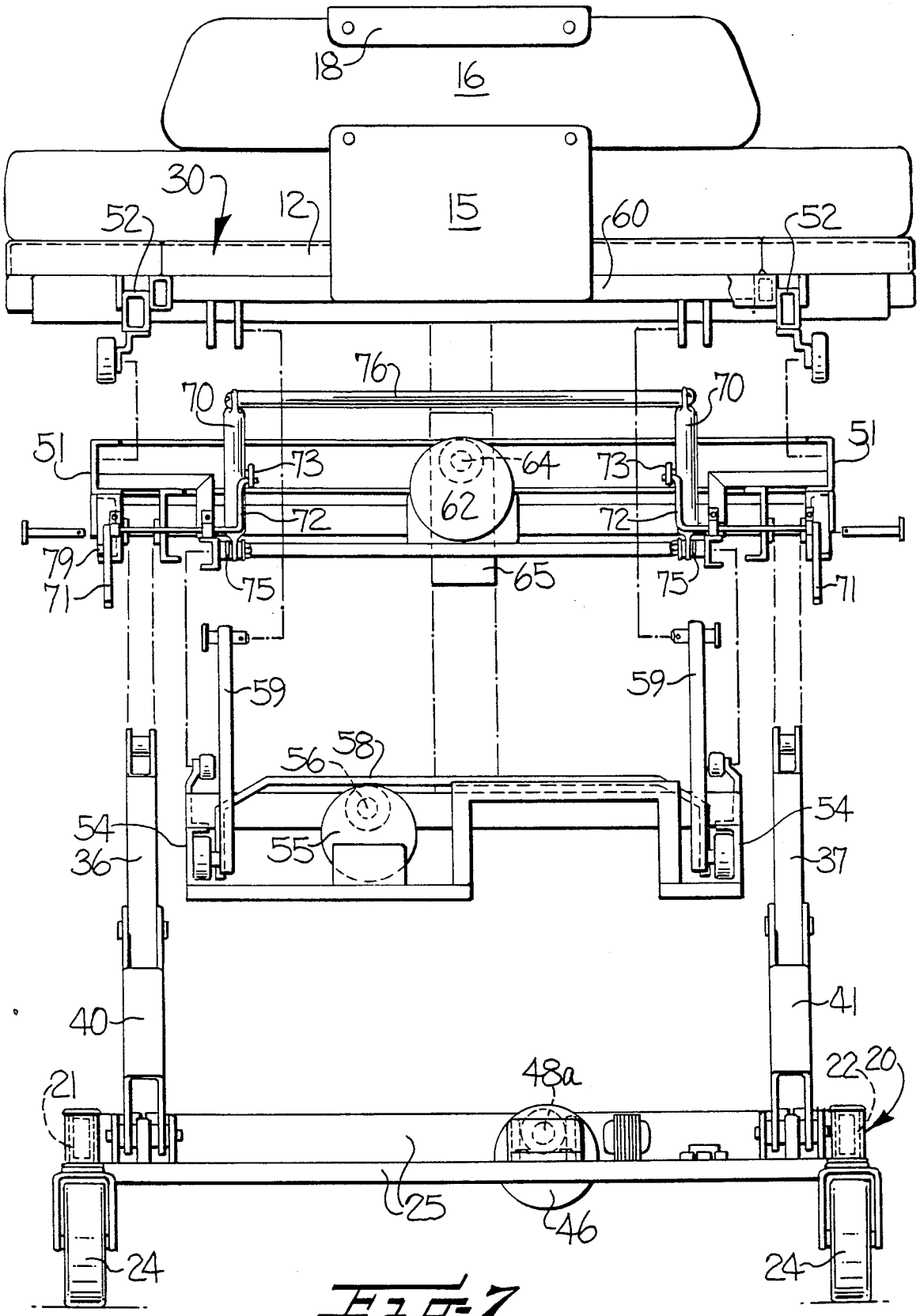
FIG. 7 is a view similar to FIG. 3, exploded to clarify certain relationships among elements of the bed of the present invention.
Figure 8:
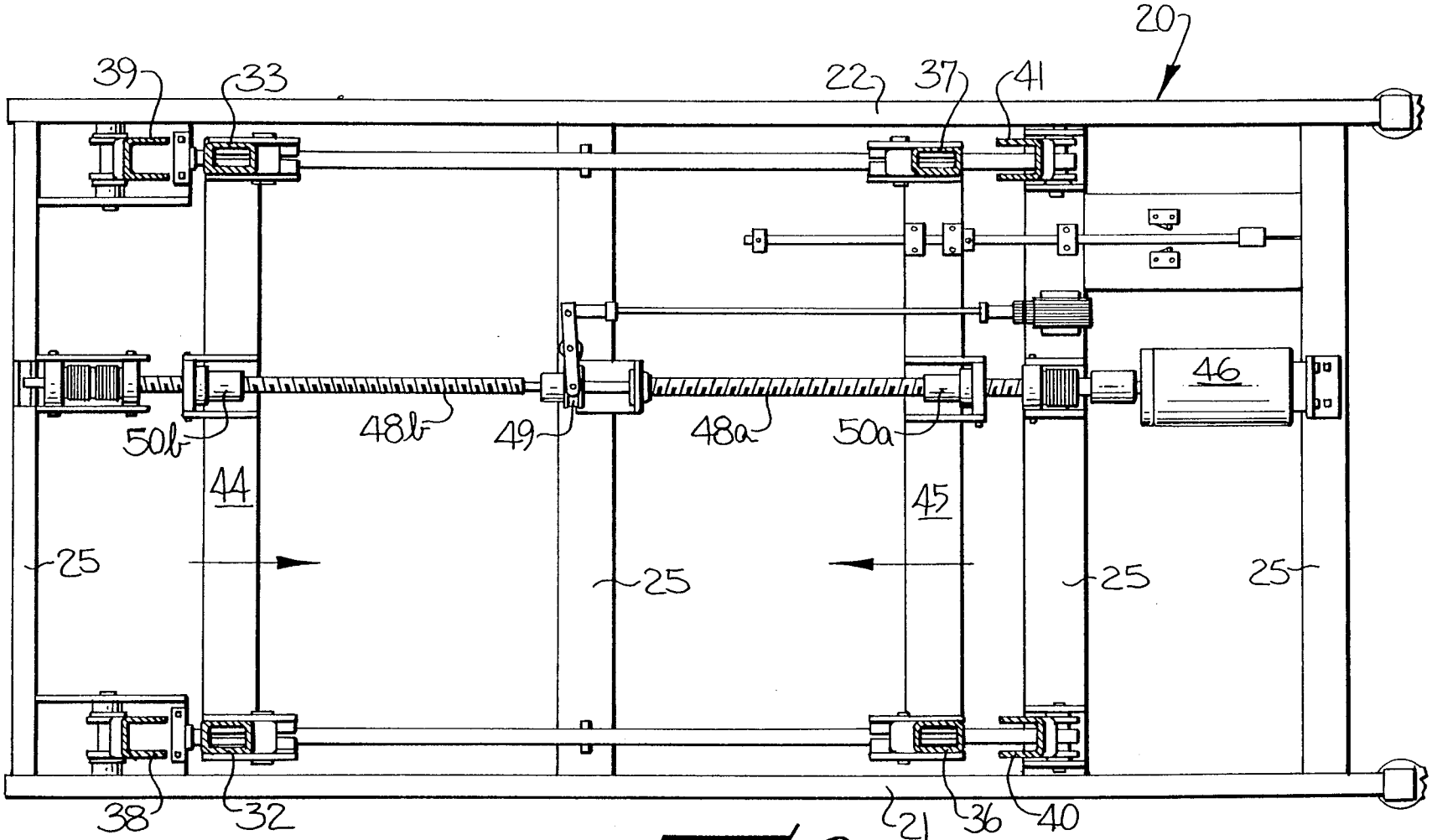
FIG. 8 is a sectional plan view showing certain elements of the bed of the present invention.
Figure 9:
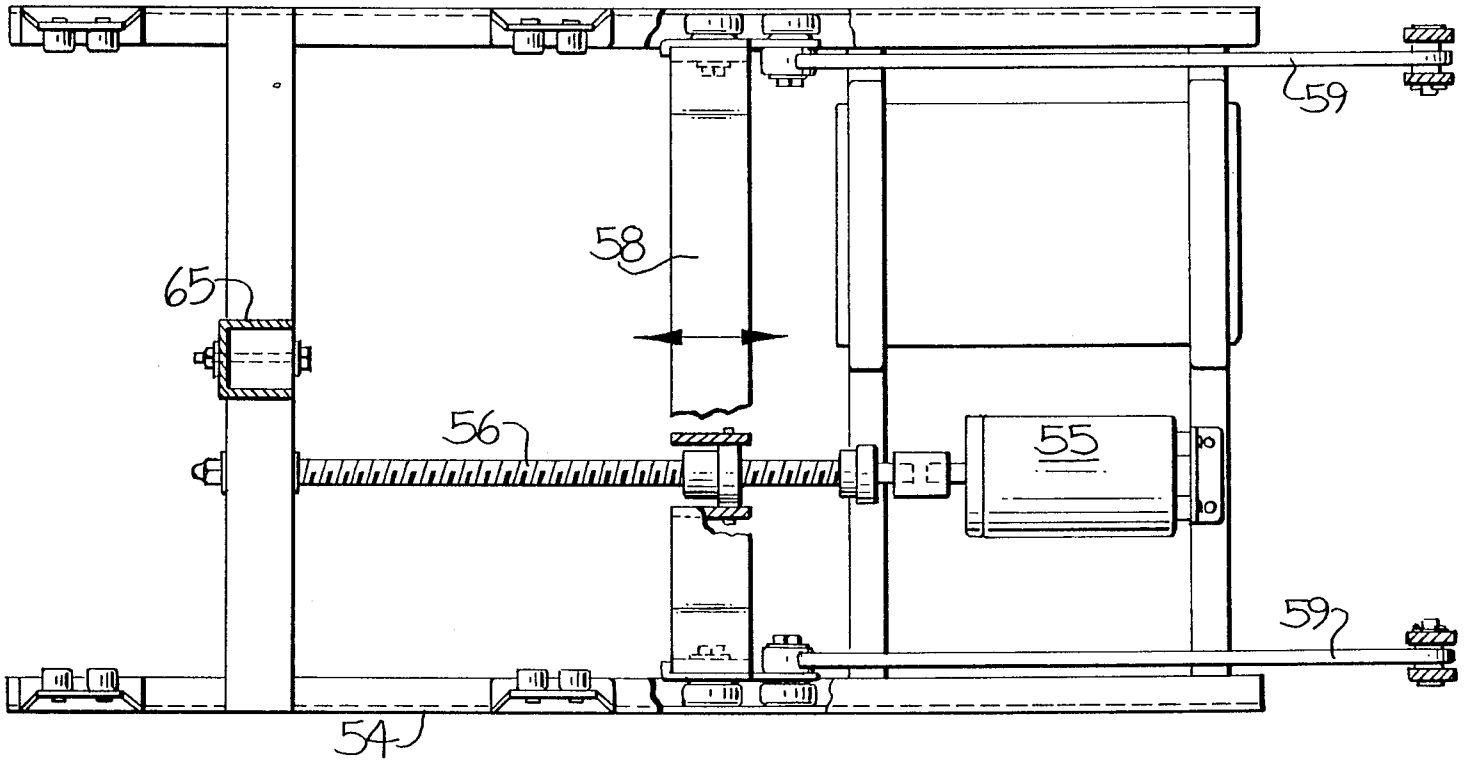
FIGS. 9 through 12 are views similar to FIG. 8, taken at various levels through the bed of the present invention and illustrating the various elements of the bed of the present invention.
Figure 10:
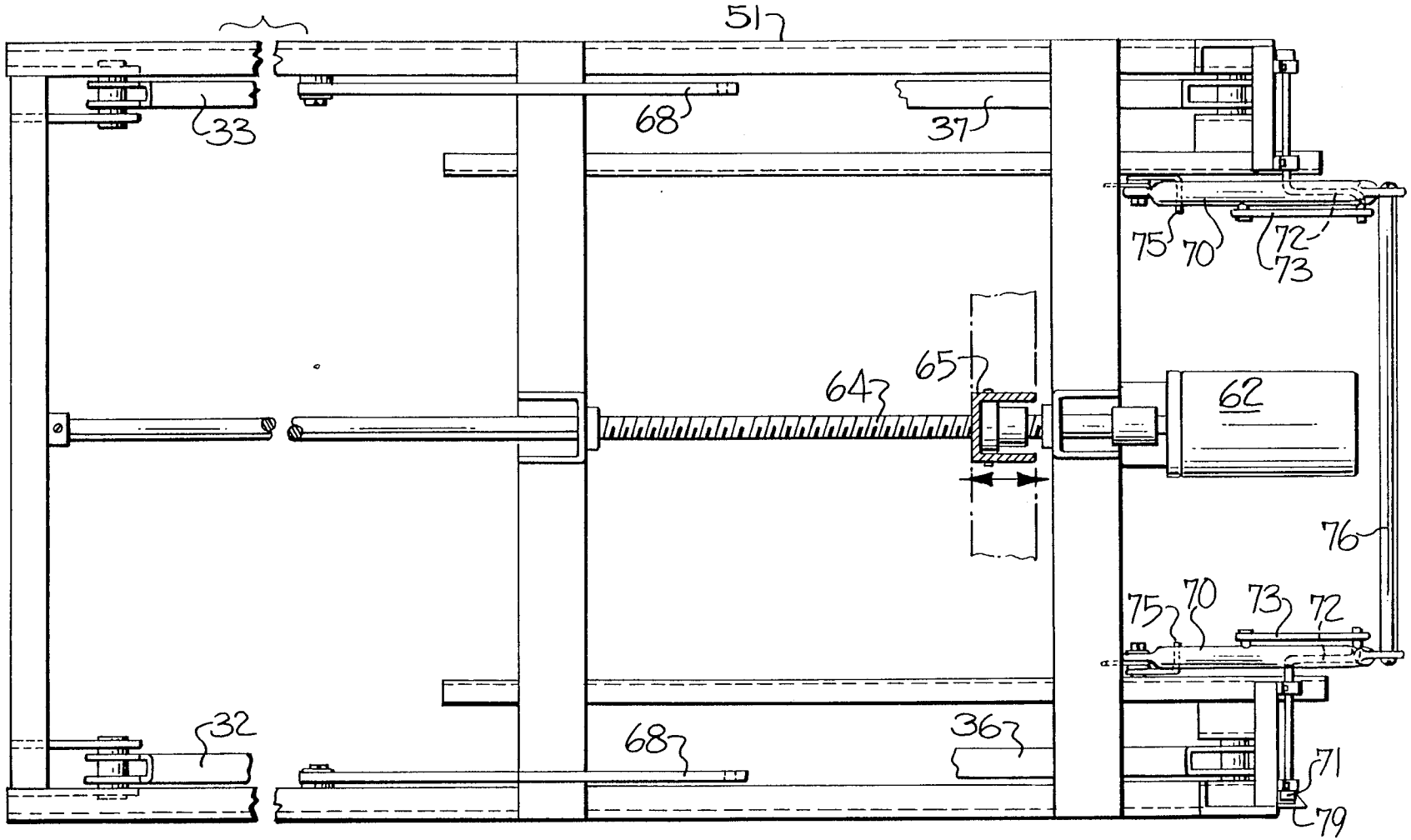
Figure 11:
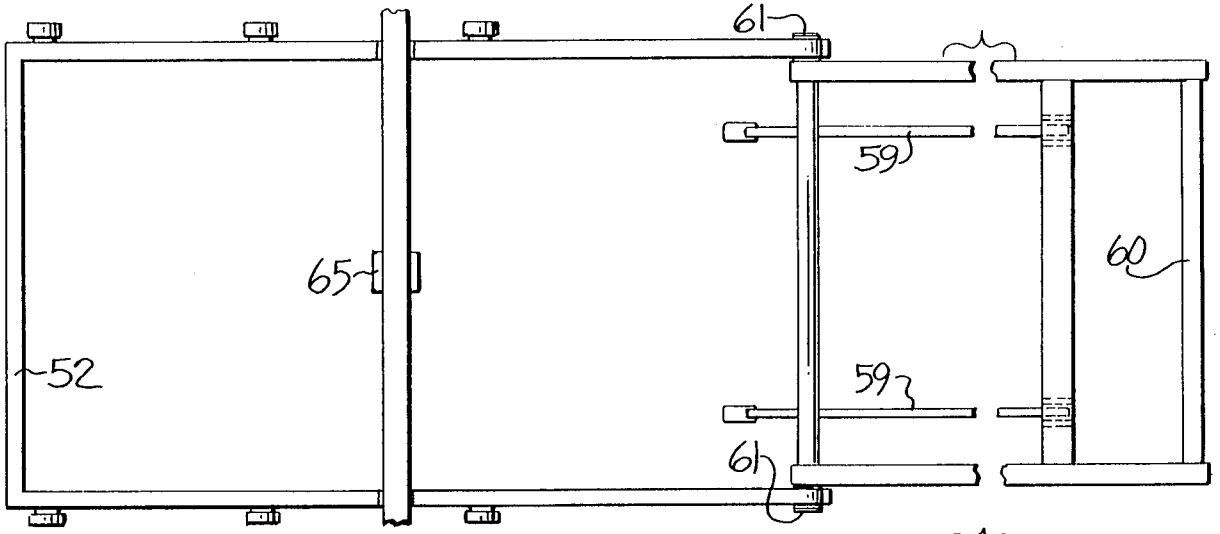
Figure 12:
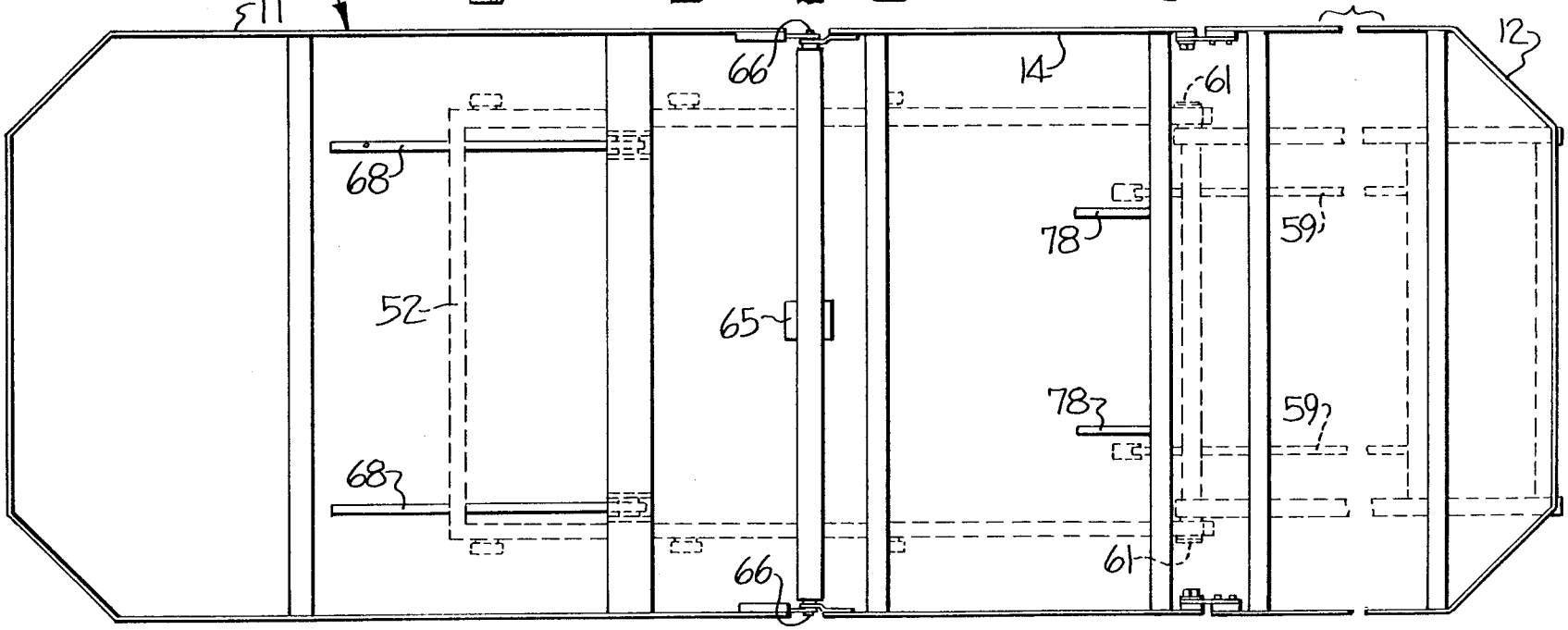
Figure 13:
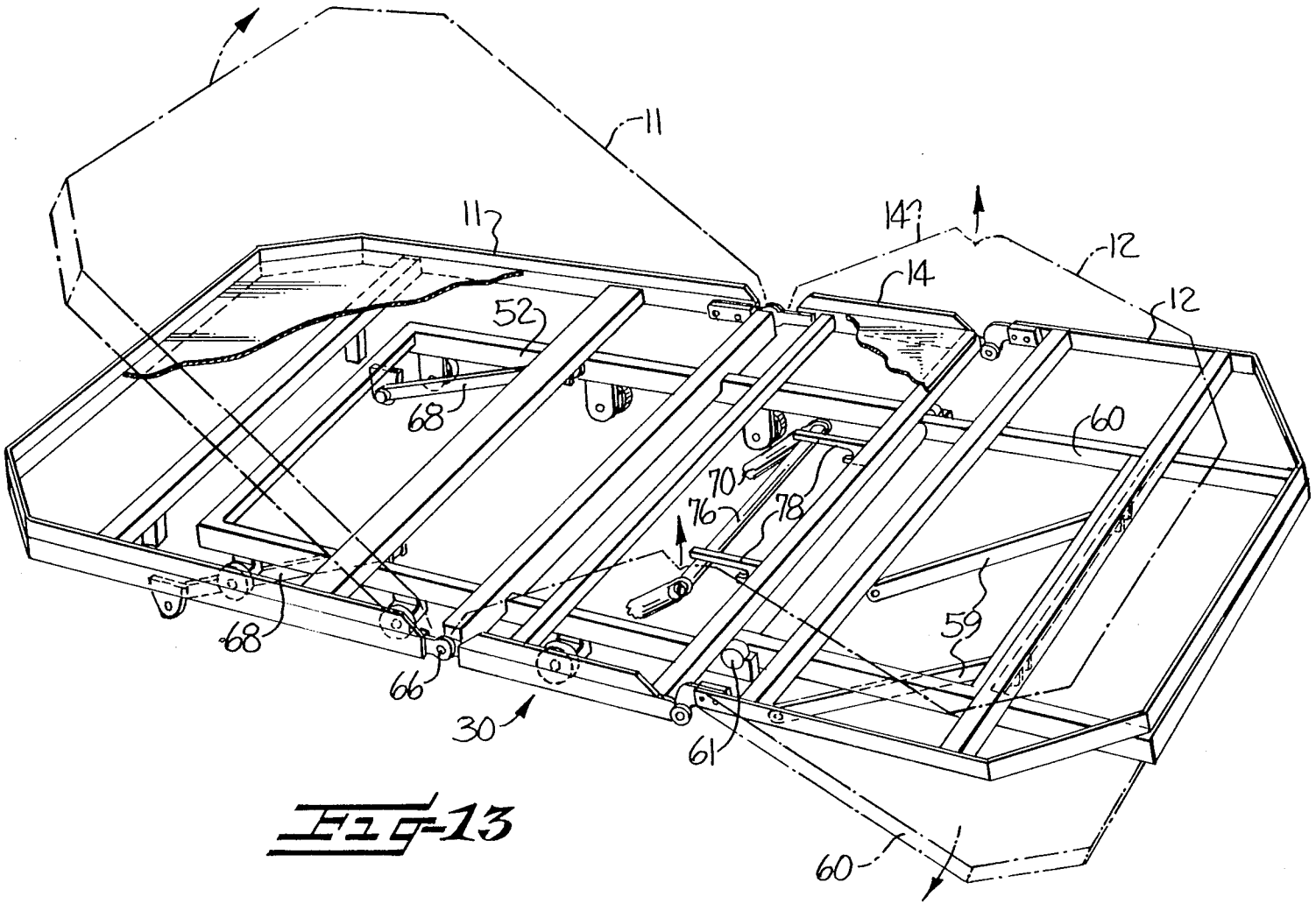
FIG. 13 is a perspective view of certain elements of the bed of the present invention, illustrating the movement thereof between two particular positions.
Figure 14:
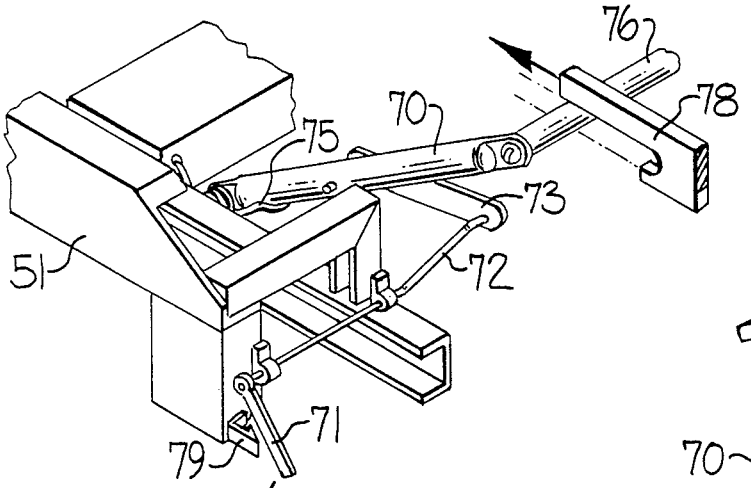
FIGS. 14 through 16 are partial perspective views of components of the position controlling mechanism of the bed of FIGS. 1 through 13, illustrating the operation thereof during certain movements.
Figure 15:
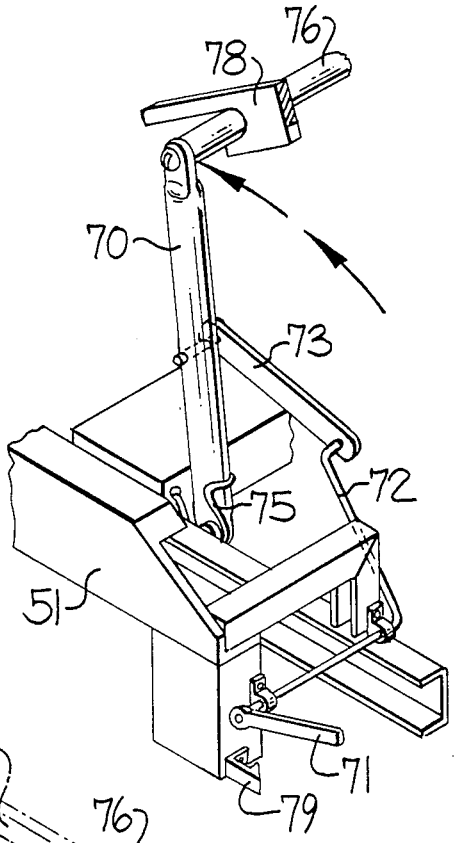
Figure 16:
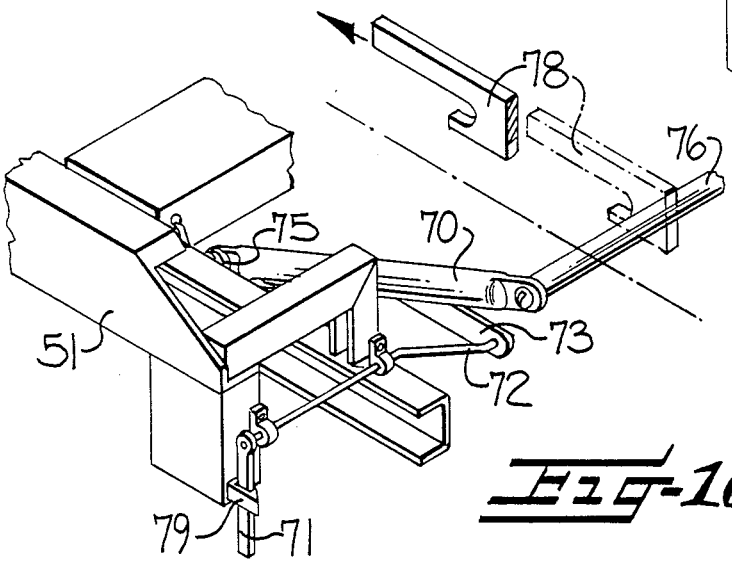
Figure 17:
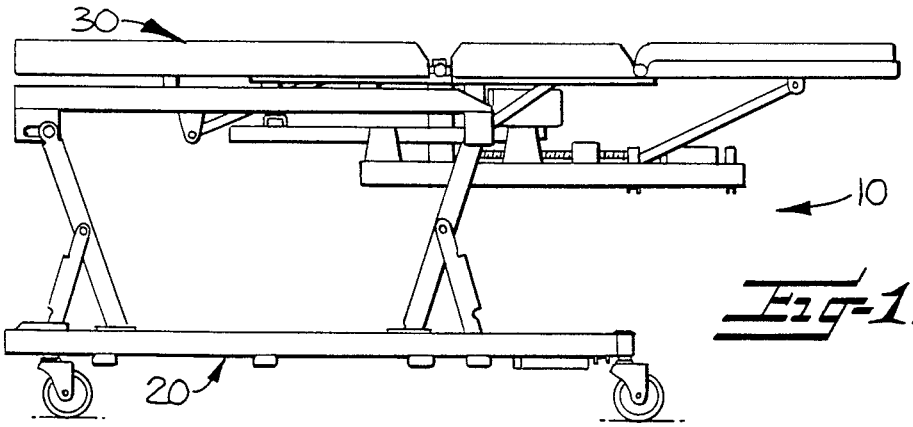
FIGS. 17 through 23 are side elevation views illustrating certain positions attainable by the bed of the present invention.
Figure 18:
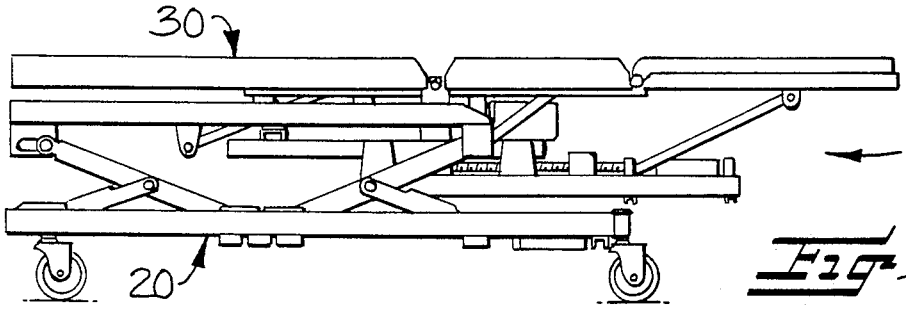
Figure 19:
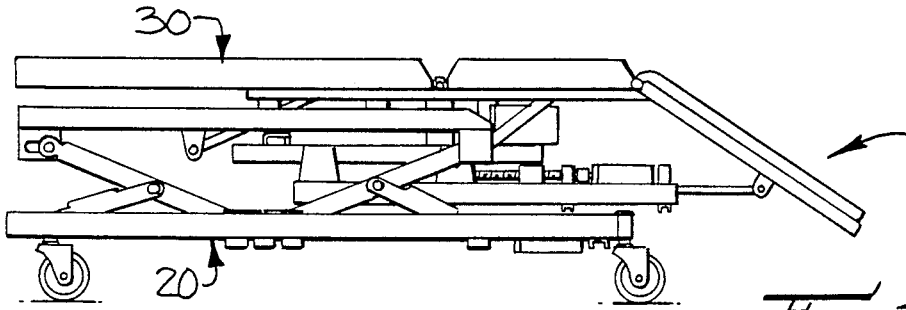
Figure 20:
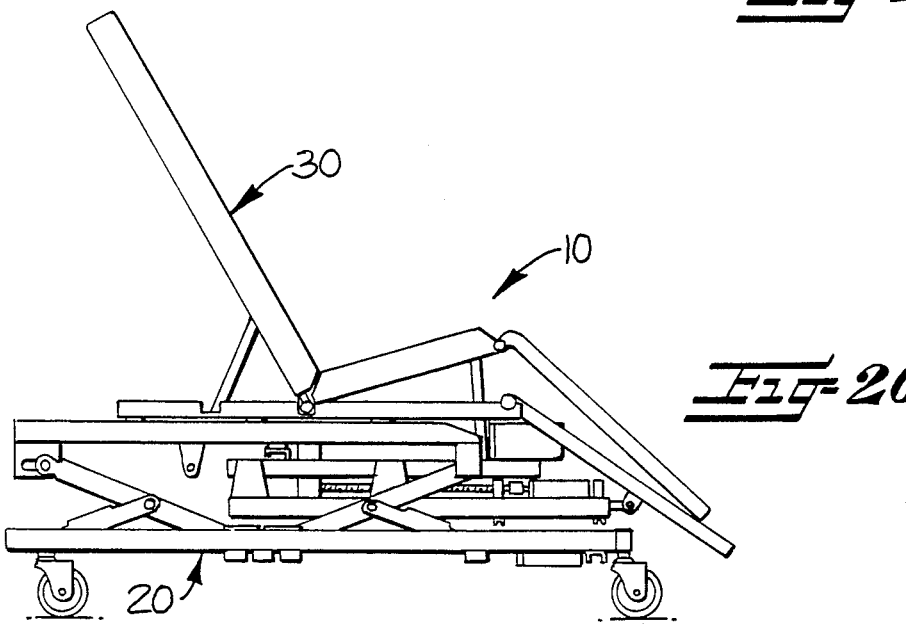
Figure 21:
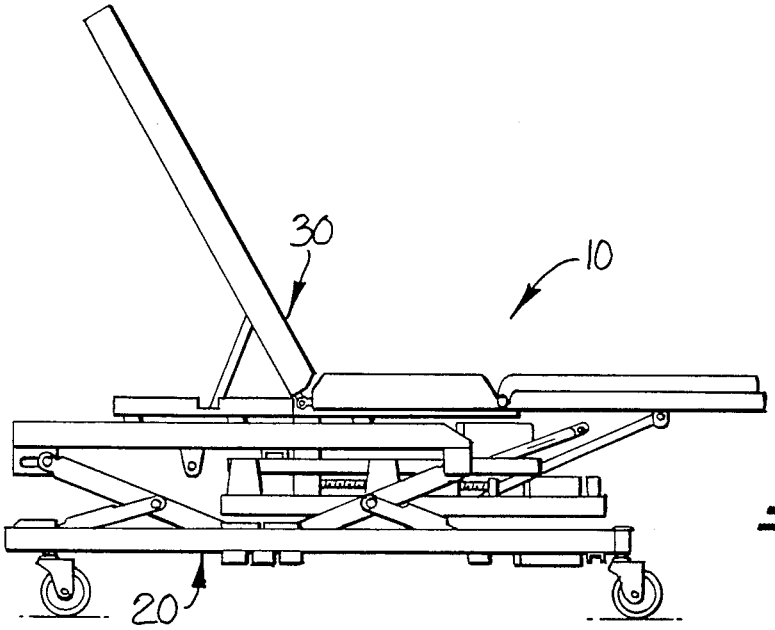
Figure 22:
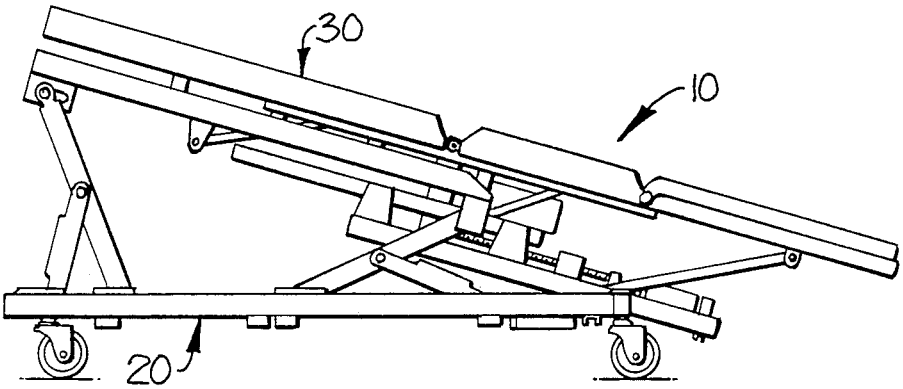
Figure 23:
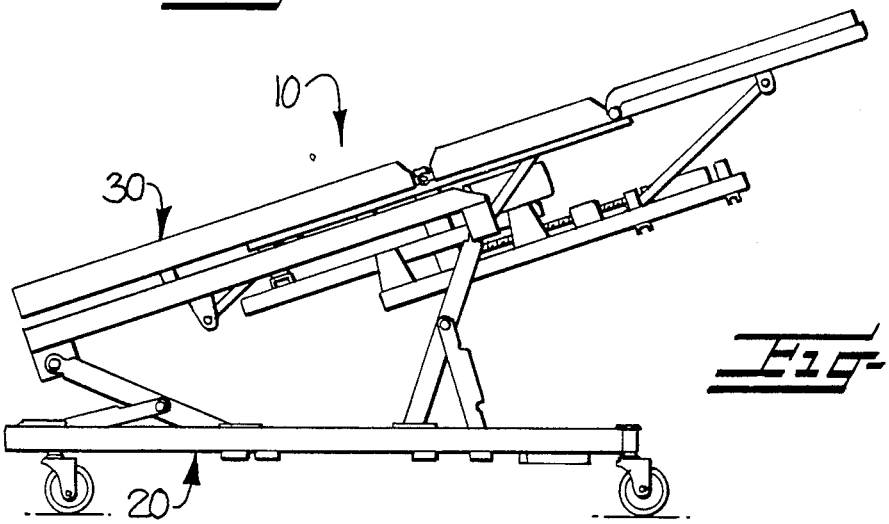

As the movements described immediately above occur and the head end portion 11 of the mattress supporting portions of the bed is moved to and from a raised or elevated position, it is possible to also change the angulation of the thigh portion 14 of the bed 10. Because it is not always comfortable to coordinate or combine head lift and thigh lift or knee break movements, change in angulation of the thigh portion 14 is optional. More particularly, a knee break arm 70 is provided and is mounted from the stationary upper frame 51. The knee break arm may be selectively biased by a spring toward an elevated position (see solid lines in FIG. 14) or may be withdrawn (FIG. 15). Particularly, and referring to FIGS. 14 and 15, a knee break control handle 71 is provided and which may, through a connecting rod 72 and link 73, move the arm 70 downward against the biasing force of a spring 75 which normally urges the arm 70 toward a raised position. The upper end of the knee break arm 70, adjacent the thigh portion 14, is connected to a coupling bar 76. The coupling bar 76 may be moved into and out of the path of movement of an actuating hook 78. More particularly, where the knee break arm 70 is moved toward the raised position by the biasing force of the spring 75, the bar 76 is positioned in the path of the hook 78 as translational movement of the thigh portion 14 occurs in response to actuation of the head lift motor 62. With such translational movement (indicated by an arrow in FIG. 14), the hook 78 engages the rod 76 and the knee break arm 70 functions as a pivoting link to elevate the foot end of the thigh portion 14 (FIGS. 5 and 14). Should it be desired that the knee break not occur, then the actuating handle 71 may be latched with a catch member 79 (FIG. 15) so as to lower the knee break arm 70 against the biasing force of the spring 75 and position the actuating rod 76 below the path of travel of the hook 78. As a consequence, with translating movement of the thigh portion 14, the hook 78 passes over and does not engage the rod 76. Absent the action of the pivoting knee break arm 70, the thigh portion 14 is maintained essentially horizontal by the moving upper frame 52.

As will be appreciated, the translation of the mattress supporting portions 11, 12, 14 and the lifting of one or both of the head portion 11 and the thigh portion 14 as described above may be combined with movement of the swing frame 60 which will control the position of the foot end portion 12. Thus, a wide range of positions are available for selection. Indeed, the interconnection of the elements described hereinabove is such that the swing frame 60 may be pivoted downwardly to an extreme position in which the foot end portion 12 of the bed 10 approaches the vertical, thereby approximating a chair position.

As will be appreciated from the description given above, the three drive motors 46, 55, 62 provided in the bed 10 of the present invention provide a wide variety of positions into which the elements of the bed of the present invention may be moved. It is contemplated that control over the actuation of the motor means of the bed of the present invention may be accomplished by sophisticated control circuits which will provide for coordinated actuation of one or more of the motors at the same time or in predetermined sequence so as to most efficiently accomplish movement of the elements of the bed 10 to and from desired or preselected positions. While it is to be understood that such control is contemplated, it is also to be understood that the primary thrust of the description here given is toward the structural organization and arrangement of the elements of the bed, as it is contemplated that such control may be accomplished in a variety of manners. It is also contemplated that, while certain specific constructional details of the bed 10 of the present invention have been given, many of the structural details may be selected or modified by persons of appropriate skill in the design of bed linkages and structures. Accordingly, detailed descriptions of bearing arrangements and the like have not been given.

In the drawings and specification, there has been set forth a preferred embodiment of the invention, and although specific terms are employed, they are used in a generic and descriptive sense only and not for purposes of limitation.

That which is claimed is:

1. In an adjustable bed having mattress supporting portions for supporting a mattress for an occupant in a variety of positions and including a head portion at a head end of the bed, a foot portion at a foot end of the bed, and a thigh portion between the head and foot portions, base frame means for supporting the mattress supporting portions, and position controlling mechanism operatively interconnecting the mattress supporting portions and the base frame means, an improvement in said position controlling mechanism which facilitates movement of the bed into a variety of positions and comprising:

upper frame means having a head end and a foot end and operatively connected with said mattress supporting portions for moving said portions relative to said base frame means and one another and comprising lifting frame means operatively connected with said lifting arm means for movement vertically relative to said base frame means, and moving frame means mounted on said lifting frame means for movement longitudinally relative thereto, lifting arm means operatively connecting said upper frame means and said base frame means for moving said head and foot ends of said upper frame means vertically relative to said base frame means and thereby for moving said mattress supporting positions, and motor means operatively connected with said upper frame means and with said lifting arm means for moving said upper frame means and said lifting arm means and thereby for positioning said mattress supporting portions in a desired position, said motor means comprising a foot drop motor mounted on said moving frame means for movement therewith and operatively connected with said foot portion of said mattress supporting portions for pivoting said foot portion relative to said thigh portion.

2. An adjustable bed according claim 1 wherein said lifting arm means comprises a pair of head end lifting arms and a pair of foot end lifting arms, and further wherein said motor means comprises a bed height motor mounted on said base frame means and selectively operatively connected with said lifting arms for moving lower ends of said pairs of lifting arms toward and away from one another and for moving said foot end lifting arms independently of said head end lifting arms so as to raise and lower said upper frame means and to pivot said upper frame means relative to a horizontal plane.

3. In an adjustable bed having mattress supporting portions for supporting a mattress for an occupant in a variety of positions and including a head portion at a head end of the bed, a foot portion at a foot end of the bed, and a thigh portion between the head and foot portions, base frame means for supporting the mattress supporting portions, and position controlling mechanism operatively interconnecting the mattress supporting portions and the base frame means, an improvement in said position controlling mechanism which facilitates movement of the bed into a variety of positions and comprising:

upper frame means having a head end and a foot end and operatively connected with said mattress supporting portions for moving said portions relative to said base frame means and one another, said upper frame means comprising lifting frame means mounted for movement vertically relative to said base frame means and fixed against movement longitudinally relative to said base frame means and further comprising moving frame means mounted on said lifting frame means for translation therealong longitudinally relative to said base frame means and said lifting frame means, lifting arm means comprising a pair of head end lifting arms and a pair of foot end lifting arms operatively connecting said upper frame means and said base frame means for moving said head and foot ends of said upper frame means vertically relative to said base frame means and thereby for moving said mattress supporting portions, head lift motor means mounted on said lifting frame means and operatively connected with said mattress supporting portions for simultaneously moving said mattress supporting portions lengthwise of said lifting frame means and pivoting said head portion upwardly for lifting the head of an occupant of the bed, and foot drop motor means mounted on said moving frame means for movement therewith and operatively connected with said foot portion of said mattress supporting portions for pivoting said foot portion relative to said thigh portion.

4. An adjustable bed comprising a base frame, upper frame means having a head end and a foot end and including lifting frame means mounted for movement vertically relative to said base frame means and fixed against movement longitudinally relative to said base frame means, and further including moving frame means mounted on said lifting frame means for translation therealong longitudinally relative to said base frame means and said lifting frame means, mattress supporting means mounted on said upper frame means for supporting a mattress for an occupant in a variety of positions and including a head portion at a head end of the bed, a foot portion at a foot end of the bed, and a thigh portion between the head and foot portions, lifting arm means including a pair of head end lifting arms and a pair of foot end lifting arms with each pair operatively connecting said lifting frame means and said base frame means for moving said head and foot ends of said upper frame means vertically relative to said base frame means and thereby for moving said mattress supporting portions, bed height motor means mounted on said base frame means and selectively operatively connected with said lifting arms for moving said pairs of lifting arms toward and away from one another and for moving said foot end lifting arms independently of said head end lifting arms so as to raise and lower said upper frame means and to pivot said upper frame means relative to a horizontal plane, head lift motor means mounted on said lifting frame means and operatively connected with said mattress supporting portions for simultaneously moving said mattress supporting portions lengthwise of said lifting frame means and pivoting said head portion upwardly for lifting the head of an occupant of the bed, and foot drop motor means mounted on said sliding frame means for movement therewith and operatively connected with said foot portion of said mattress supporting portions for pivoting said foot portion relative to said thigh portion.

* * * * *